US012781969B2

(12) United States Patent
Guenter

(10) Patent No.: US 12,781,969 B2
(45) Date of Patent: Nov. 3, 2026

(54) METHOD FOR COOLING THE VAPOR OR STEAM ESCAPING FROM THE COOKING CHAMBER OF A COOKING DEVICE, AND COOKING DEVICE

(71) Applicant: Miele & Cie. KG, Guetersloh (DE)

(72) Inventor: Anna Guenter, Lippstadt (DE)

(73) Assignee: MIELE & CIE. KG, Guetersloh (DE)

( * ) Notice: Subject to any disclaimer, the term of this patent is extended or adjusted under 35 U.S.C. 154(b) by 465 days.

(21) Appl. No.: 18/558,195

(22) PCT Filed: Apr. 25, 2022

(86) PCT No.: PCT/EP2022/060873

§ 371 (c)(1),
(2) Date: Oct. 31, 2023

(87) PCT Pub. No.: WO2022/238100

PCT Pub. Date: Nov. 17, 2022

(65) Prior Publication Data

US 2024/0230104 A1 Jul. 11, 2024

(30) Foreign Application Priority Data

May 11, 2021 (BE) ..... 2021/5378

(51) Int. Cl.
*F24C 15/00* (2006.01)
*F24C 15/32* (2006.01)

(52) U.S. Cl.
CPC ..... *F24C 15/006* (2013.01); *F24C 15/322* (2013.01)

(58) Field of Classification Search
CPC .... F24C 15/006; F24C 15/322; F24C 15/325; F24C 15/2007; F24C 7/085; F24C 7/08
See application file for complete search history.

(56) References Cited

U.S. PATENT DOCUMENTS

| | | | | |
|---|---|---|---|---|
| 9,134,036 | B2 * | 9/2015 | Bagwell | F24C 15/2007 |
| 10,215,421 | B2 * | 2/2019 | Bagwell | F24C 15/20 |
| 2009/0039068 | A1 * | 2/2009 | Boutwell | F24C 15/008 219/220 |
| 2012/0152223 | A1 * | 6/2012 | Sillmen | F24C 15/006 126/21 A |

(Continued)

FOREIGN PATENT DOCUMENTS

| | | | |
|---|---|---|---|
| DE | 102010061339 | A1 | 6/2012 |
| DE | 102011010906 | A1 | 8/2012 |

(Continued)

*Primary Examiner* — Ko-Wei Lin
(74) *Attorney, Agent, or Firm* — LEYDIG, VOIT & MAYER, LTD.

(57) ABSTRACT

A method for cooling vapor or steam escaping from a cooking chamber of a cooking device equipped with a cooking chamber, a door for closing a front-side loading opening of the cooking chamber, a cooling device for replacing some of the vapor or steam in the cooking chamber with cold air, and a control device for actuating the cooling device as a function of a control command, the method including: triggering the control command by a signal or measured value of a proximity sensor arranged on the cooking device, the signal or measured value being generated by the proximity sensor as a result of an individual approaching the cooking device.

20 Claims, 9 Drawing Sheets

(56) References Cited

U.S. PATENT DOCUMENTS

| | | | | |
|---|---|---|---|---|
| 2013/0149947 | A1* | 6/2013 | Bagwell | F24C 15/2007 454/49 |
| 2014/0014084 | A1* | 1/2014 | Rudolph | G06F 3/0443 126/1 R |
| 2015/0234364 | A1* | 8/2015 | Gardner | H05B 6/6435 700/275 |
| 2017/0082296 | A1* | 3/2017 | Jeong | F24C 15/28 |
| 2020/0217514 | A1* | 7/2020 | Clayton | F24C 7/085 |
| 2021/0058689 | A1* | 2/2021 | Grant | H04R 1/026 |
| 2021/0311681 | A1* | 10/2021 | Lees | G06F 3/14 |
| 2022/0065460 | A1* | 3/2022 | Bauer | F24C 7/085 |
| 2022/0186940 | A1* | 6/2022 | Todd | F24C 15/006 |
| 2023/0067958 | A1* | 3/2023 | Lee | F24C 7/085 |

FOREIGN PATENT DOCUMENTS

| | | | |
|---|---|---|---|
| DE | 102016121834 | A1 | 5/2018 |
| DE | 102018104297 | A1 | 8/2019 |
| EP | 2180259 | A1 | 4/2010 |
| EP | 3324124 | A1 | 5/2018 |
| EP | 3324125 | A1 | 5/2018 |
| EP | 3450857 | A2 | 3/2019 |
| EP | 3647664 | A1 | 5/2020 |
| KR | 20190001887 | A | 1/2019 |
| WO | WO 2020260130 | A1 | 12/2020 |

* cited by examiner

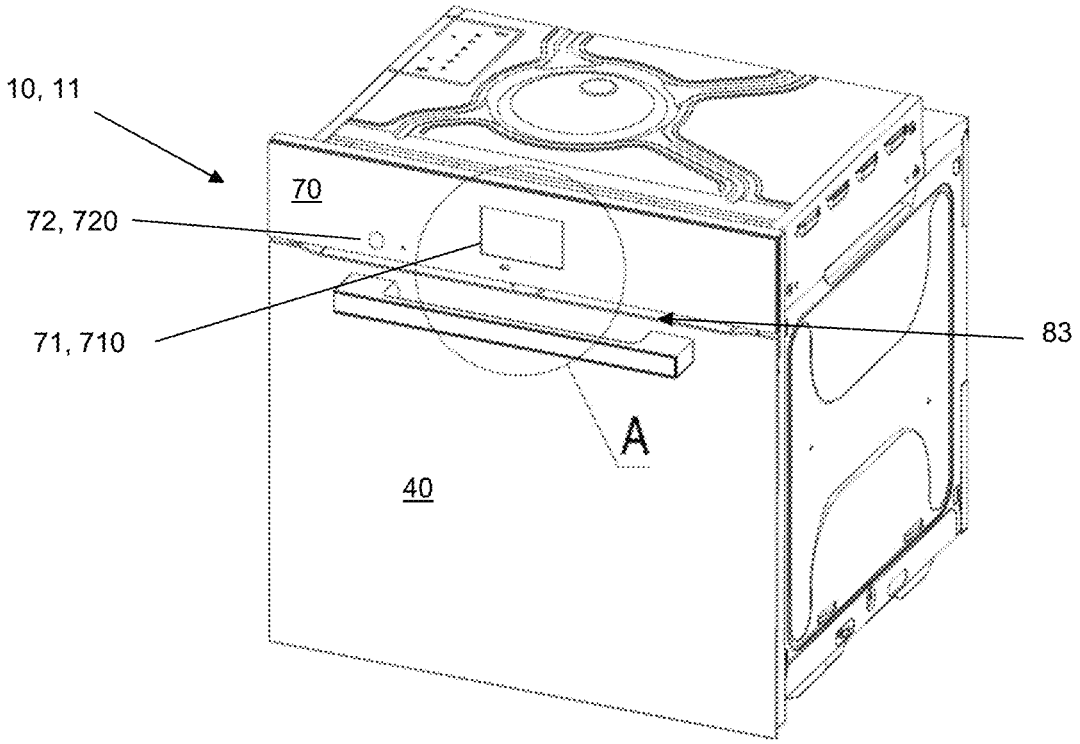
Fig. 1
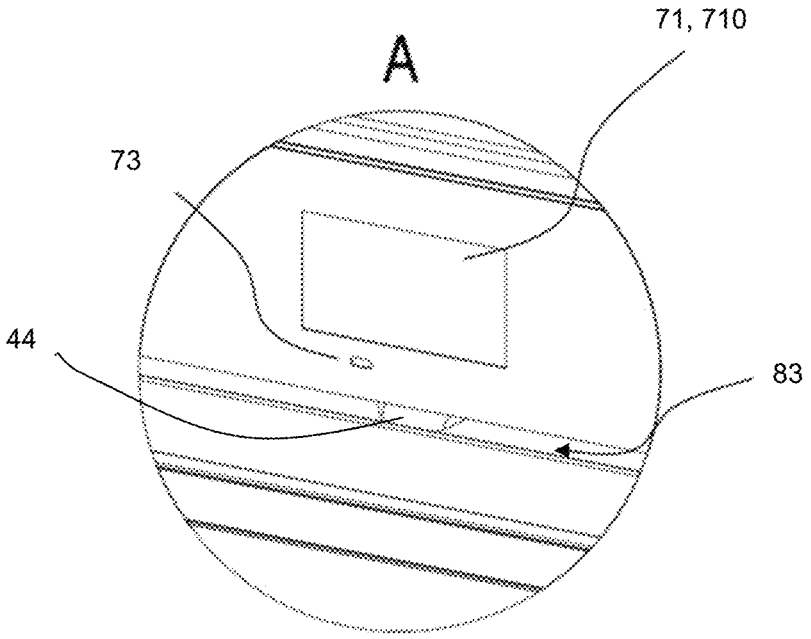

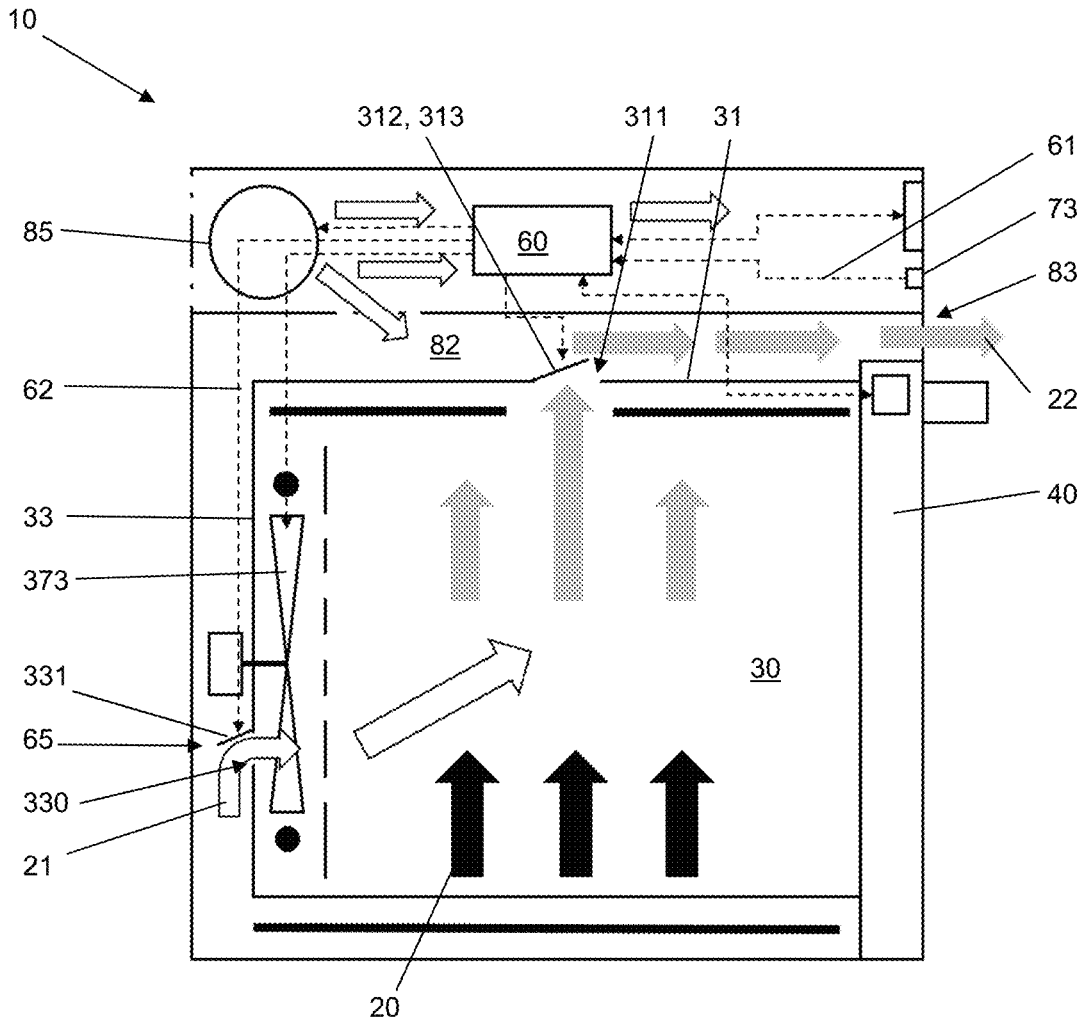
Fig. 6a
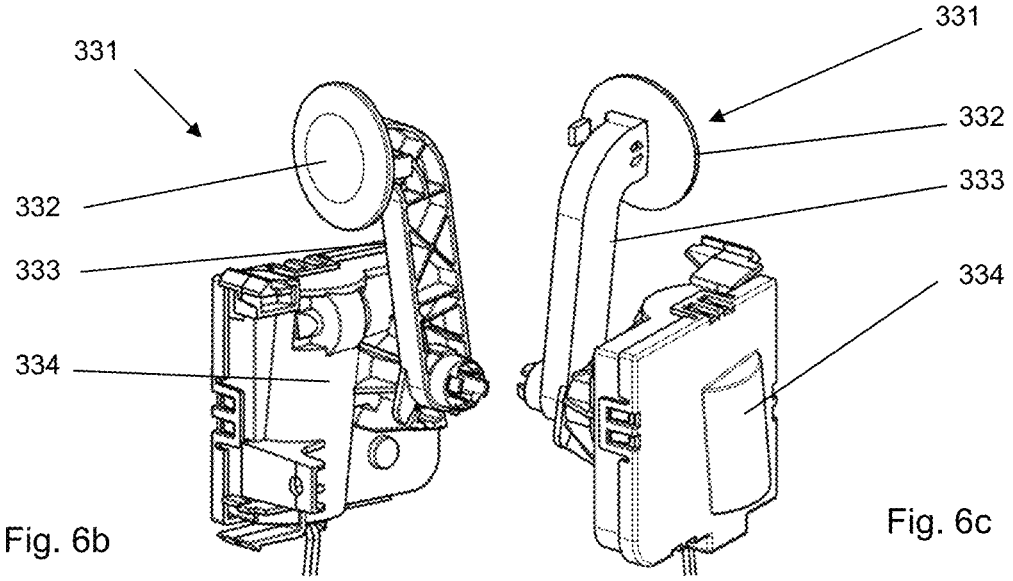
Fig. 6b
Fig. 6c

METHOD FOR COOLING THE VAPOR OR STEAM ESCAPING FROM THE COOKING CHAMBER OF A COOKING DEVICE, AND COOKING DEVICE

CROSS-REFERENCE TO PRIOR APPLICATIONS

This application is a U.S. National Phase application under 35 U.S.C. § 371 of International Application No. PCT/EP2022/060873, filed on Apr. 25, 2022, and claims benefit to Belgian Patent Application No. BE 2021/5378, filed on May 11, 2021. The International Application was published in German on Nov. 17, 2022 as WO/2022/238100 A1 under PCT Article 21(2).

FIELD

The invention relates to a method for cooling the vapor or steam escaping from the cooking chamber of a cooking device, in particular of an oven or steam cooker, wherein the cooking device is equipped with a cooking chamber, a door for closing a front-side loading opening of the cooking chamber, a cooling device for replacing some of the vapor or steam in the cooking chamber by cold air, and with a control device for actuating the cooling device as a function of a control command. The invention further relates to a cooking device for carrying out such a method.

BACKGROUND

When using cooking devices, hot vapor arises when heating food to be cooked, which vapor is formed from the moisture that is initially inside the food to be cooked and is then released to the external environment depending on the cooking progress. Furthermore, there are cooking devices in which water steam (steam) is supplied to the cooking chamber for heating or to support the cooking process. Such cooking devices are primarily ovens or steam cookers, but also combination devices in which steam, radiation heat and dielectric heating via microwaves are used in combination. If, during the cooking process, the door of one of the aforementioned devices is manually opened by an operator, the vapor or steam present in the cooking chamber can abruptly escape through the thus at least partially opened loading opening and can startle the operator or lead to impairments such as fogging of eyeglass lenses. In the following description, for reasons of simplification, only the term steam will be used, even if vapor might be meant.

As is known, hot steam can transmit a very large amount of energy, and water is the element or substance occurring in everyday life with one of the highest energy densities or heat capacities. It can be unpleasant when coming into direct contact with the human skin. It is advisable to prevent the formation of steam as far as possible in all conceivable situations, in particular during the user-initiated opening of doors, not only for the well-being and physical integrity of prospective or already established home chefs and professional chefs, but also in order to avoid side effects occurring in conjunction with steam in kitchens or similar spaces (impact of temperature and steam on adjacent devices and furniture, undesired moisture and condensation effects or deposits).

In order to reduce an abrupt escape of steam, it is known, for example, from EP 2 180 259 A1 to provide a deflection device in an oven which has a cooling air outlet above the cooking chamber door, which deflection device, when the door is opened, pivots into the air flow into the cooling air outlet, thereby deflecting the air parallel to the loading opening and thus forming an air curtain which prevents the steam from escaping from the opening. Similar devices are known from US 2017 0 082 296 A1 and from EP 3 450 857 A2.

Furthermore, it is known to continuously remove some of the steam present in the cooking chamber from said cooking chamber during a cooking process and to replace it by cold air. For this purpose, an opening is generally arranged in the ceiling in order to connect the cooking chamber to the suction side of a cooling fan located above. The cooling fan moreover draws in cold air from the surroundings of the cooking device and mixes the steam from the cooking chamber with the cold air. The proportion of cold air is generally greater than the proportion of steam due to the constructive design of the fan and air paths, so that the mixed air generated in the cooling fan is still relatively cold. The mixed air is first guided via electrical and electronic components for cooling thereof and is then blown out of the device front via a flow line. As a result of leaks in the cooking chamber in the region of the door, of the air circulation fan or of the lighting system, cold air is also drawn in from the external environment of the device, which replaces the steam escaping from the opening in the cover. However, replacement through the opening during a standard cooking program is generally only low and does not result in a significant reduction in steam in the cooking chamber. From DE 10 2016 121 834 A1, it is known to vary the size of the opening between the cooking chamber and the flow line by means of a movable closure element. Furthermore, it is known to carry out a so-called rapid cooling in a program-controlled manner at the end or during a cooking program, in which a similar closure element is completely removed from the opening and/or the door is opened at least by a gap, see DE 10 2010 061 339 A1.

DE 10 2018 104 297 A1 describes a household appliance in which an infrared transmitter and an infrared detector form a proximity sensor which is capable of detecting when an individual approaches the device.

SUMMARY

In an embodiment, the present invention provides a method for cooling vapor or steam escaping from a cooking chamber of a cooking device equipped with a cooking chamber, a door for closing a front-side loading opening of the cooking chamber, a cooling device for replacing some of the vapor or steam in the cooking chamber with cold air, and a control device for actuating the cooling device as a function of a control command, the method comprising: triggering the control command by a signal or measured value of a proximity sensor arranged on the cooking device, the signal or measured value being generated by the proximity sensor as a result of an individual approaching the cooking device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 shows a perspective view of a built-in oven 11;

FIG. 6*a* shows a schematic diagram of a third embodiment of a built-in oven 11 according to the invention;

FIG. 6*b, c* show a second flap unit 331 of this embodiment;

DETAILED DESCRIPTION

Figure 2A:
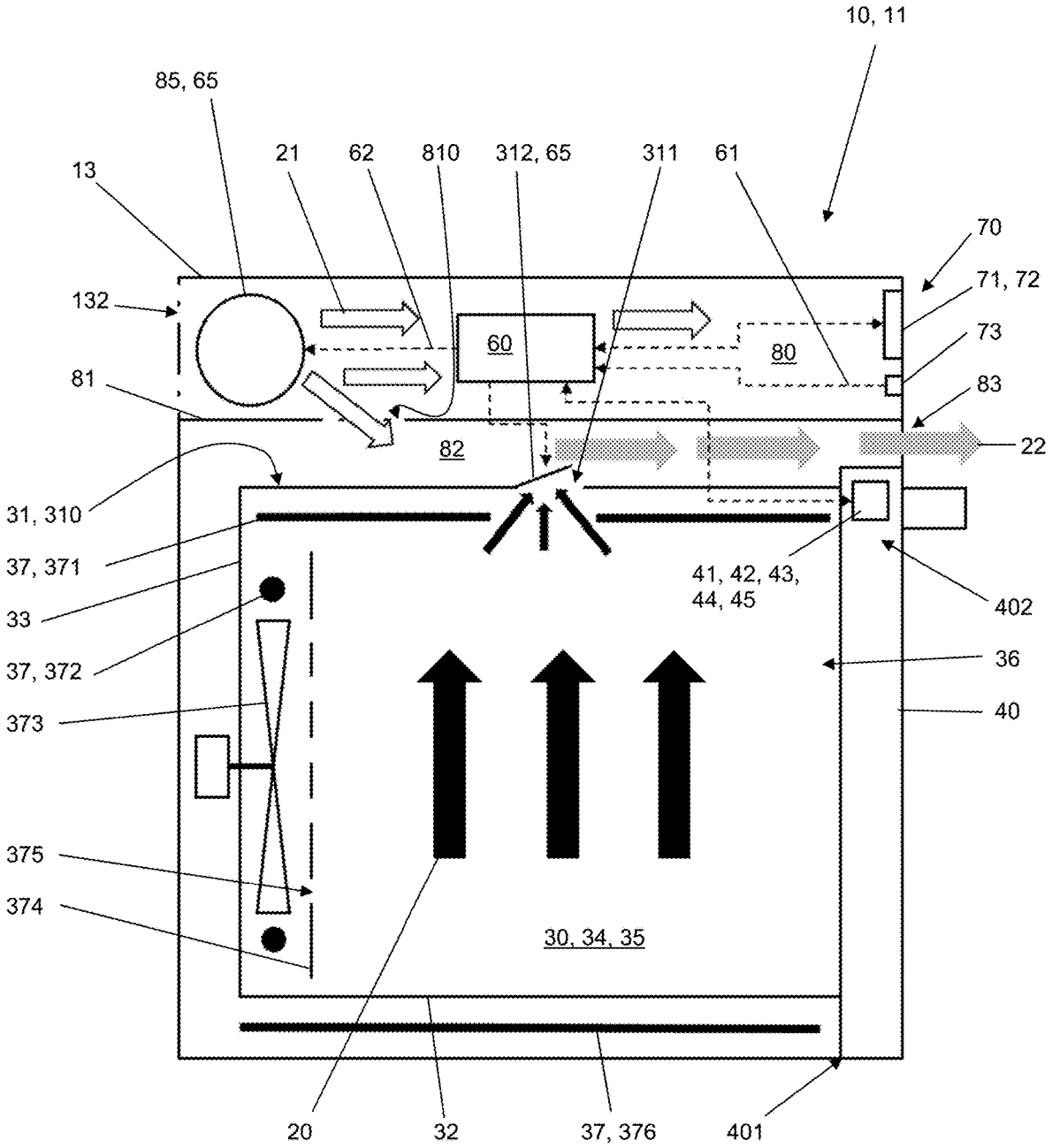
FIG. 2*a* to *c* show schematic diagrams of first embodiments of a built-in oven 11 according to the invention.

In an embodiment, the present invention provides a method of the type mentioned at the outset and a cooking device for carrying out such a method in which the steam escaping from the loading opening is further reduced when the door is opened.

In a method for cooling the steam escaping from the cooking chamber of a cooking device, in particular an oven or steam cooker, wherein the cooking device is equipped with a cooking chamber, a door for closing a front-side loading opening of the cooking chamber, a cooling device for replacing some of the steam in the cooking chamber by cold air, and with a control device for actuating the cooling device by a control command, the advantages according to the invention are achieved in that the control command is triggered by the signal or measured value of a proximity sensor arranged on the cooking device, wherein the signal or measured value is generated by the proximity sensor as a result of an individual approaching the cooking device. Cooling the escaping steam within the meaning of the invention is understood to mean replacing some of the cooking chamber atmosphere with cold air before or at the latest when the door is opened. The loading opening in spatial terms is the surface which is formed by the front edges of the cooking chamber and are free of a cooking chamber wall. Use of the proximity sensor, with which the control command and thus a starting of the cooling device is triggered, gives the device, in particular its electromechanical components, sufficient time and possibility to bring itself into a position in which a significant amount of the cooking chamber atmosphere is replaced by cold air before or at the latest when an individual, as an operator, opens the door manually. A surge-like escape of steam from the loading opening can thereby be prevented. The proximity sensor or the control device can be suitable and designed to distinguish an approaching individual from a moving object or from an approaching animal. It is even known from the prior art to identify certain individuals as an operator by suitable image detection and evaluation, for example by gesture recognition, and to distinguish them from others randomly in the installation area of the device. If such an identification device does not exist on the device in question, the control device will initially assume that every individual approaching is an operator, and will trigger the control command for actuating the cooling device.

Advantageous embodiments of the cooling device result in that they perform the following method steps either individually or at least partially in combination with one another:

A. Increasing a blow-out air flow of a cooling fan, wherein the air flow picks up some of the vapor or steam from the cooking chamber via a first opening in the ceiling of the cooking chamber and transports it away from the cooking device via a flow line;

B. Generating a suction air flow by the cooling fan or by a further fan, wherein the suction air flow is drawn in by the cooling fan or the further fan via a flow line, and wherein the flow line extends at least from the cooling fan or the further fan up to a blow-out/suction opening in the cooking device front above the cooking chamber;

C. Increasing the first opening in the ceiling by moving an adjustable first flap unit;

D. Opening a second opening in one of the cooking chamber walls by moving an adjustable second flap unit;

E. Opening, by a gap, the door by means of an automatic opening device;

Regarding A.

By increasing the blow-out air flow, the amount of steam picked up from the cooking chamber through the first opening is significantly increased. The resulting negative pressure ensures that cold air is supplied in a successive manner through other openings, first through already existing openings or leaks in the cooking chamber, and increasingly by the door manually opened by an operator. The cooking chamber atmosphere is consequently cooled; moreover, the resulting suction effect reduces the escape of the steam through the door gap which is created and becomes larger when the door is opened. Advantageously, the increase takes place by increasing the fan speed by means of the control device. Alternatively, a second cooling fan can be used, which then also switches on the control device when an individual approaches. An increase in the blow-out air flow also favors the use of a deflection device known from the prior art, for example a pivotable strip arranged in the region of the blow-out/suction opening, which in a first position releases the blow-out air flow at least approximately in the direction of the flow line from the blow-out/suction opening and, in a second position, deflects the blow-out air flow in the direction of the loading opening. A very dense air curtain is thereby generated, which prevents the escape of steam from the loading opening even better. In such an embodiment, it is advantageous, in particular, if the strip projects with at least one part into the pivoting region of at least one part of the door, so that the strip is in the first position when the door is closed and is in the second position when the door is open. As a result, the air curtain is automatically generated by the downward pivoting of the strip without requiring further adjustment devices.

Regarding B.

The suction air flow ensures that the steam, which escapes from the cooking chamber when the door gap becomes larger during opening, is directed away from the operator and into the flow line. The cooking chamber atmosphere is then rapidly filled with cold air and cooled down. Due to the fact that the suction function of the fan is switched on during the approach of an individual—either by a reversal of the direction of rotation of the cooling fan or by switching on a further fan and optionally switching off the cooling fan—a sufficiently high suction effect can already be established when the door is opened. Advantageously, a flow line is provided which extends at least from the cooling fan or the further fan up to a blow-out and/or suction opening in the cooking device front above the cooking chamber. As a result, the steam is specifically drawn in at the location which it first reaches after the door has been opened. The effect of the fan is greatest at this point. The suction air flow can advantageously be generated by a reversal of the direction of rotation of the cooling fan by the control device. No further fan has to be used then. Alternatively, the use of a further fan is of course possible. In particular, this further fan can additionally be used to extract cooking fumes which arise in the region of a hob arranged above the cooking chamber, i.e., in the upper region of the cooking device. In such a case, it is particularly advantageous if there is a further flow line between the cooktop and the further fan and if a switching device actuated by the control device is suitable and designed to establish a fluid connection between the further fan and optionally the further flow line or the flow line. In this way, it is possible to switch from extracting cooking fumes from the hob to extracting steam from the cooking chamber.

Regarding C.

Increasing the first opening in the ceiling per se already results in a cooling of the cooking chamber atmosphere, because hot steam, following the laws of physics, rises in the cooking chamber and escapes from the opening. As already described under A., cold air is thereby drawn into the cooking chamber and an exchange of atmosphere is promoted when the door is opened. This effect is even intensified by a combination with one of the measures described under A. or B., where an additional suction is produced at the enlarged first opening. The first flap unit can, for example, be constructed as described in DE 10 2016 121 834 A1. In this embodiment of the invention, it is also advantageous if a flow line is arranged above the cooking chamber, which flow line extends up to a blow-out and/or suction opening in the cooking device front above the cooking chamber, and if the opening in the ceiling fluidically connects the cooking chamber to the flow line. Mixing of the steam, which has escaped from the cooking chamber, with cold air can then take place either in the flow line or already in a cooling fan (see A.), which prevents the steam from escaping the device in an uncooled state at another location.

Regarding D.

Cooking chamber wall refers to a wall of the cooking chamber which is not the ceiling, i.e., the wall of the cooking chamber located at the top in the operating state. The cooking chamber wall can be the base, one of the side walls, and preferably the rear wall of the cooking chamber. Providing and opening an opening in one of the cooking chamber walls creates various options for cooling the cooking chamber atmosphere. If no further openings are provided, steam can escape as a result of the excess pressure produced during heating. If, as described under A. or C., further openings are present and steam escapes from the cooking chamber via these openings, the second opening can be used to improve the supply of cold air and thus for faster cooling of the cooking chamber atmosphere. Both flap units can advantageously be moved, i.e., opened and/or closed, by actuating drives actuated by the control device. It is particularly advantageous if the control unit and the second flap device are configured to open the second opening within a period of less than 5 seconds, in particular less than 3 seconds, in particular not more than 1 second. Rapid cooling can thereby be achieved. It is particularly advantageous if, upon opening of the second opening via the control device, the latter switches on an air circulation fan for circulating the air or steam in the cooking chamber. This results in improved mixing of the cooking chamber atmosphere with cold air.

Regarding E.

A very simple way of cooling the steam in the cooking chamber before the door is opened by an operator is to have the door to the cooking chamber open by a gap before the operator carries out the actual opening process. Some of the hot steam has then already escaped and has been replaced by cold air before the door is opened completely. Opening by a gap is done by an automatic opening device which is actuated by the control device when an individual approaches. In this embodiment, it is particularly advantageous if the control device completely closes the door by means of an automatic closing device if the door opening sensor does not detect, within a predetermined period of time after the control command has been triggered by the signal or measured value of the proximity sensor, that the door is open by more than a gap. The opening and closing device can advantageously be integrated in a common mechanism, but they can also be designed as separate components. The above-described reaction of the control device and the closing device ensures that the door, which is open by a gap, is automatically closed again when an individual has approached the cooking device only randomly or without wanting to open it. Thus, it is prevented that the cooking program is continued with a door that is open by a gap.

Regarding all Variants:

In a particularly advantageous embodiment of the method, the cooling device is actuated as a function of a control command of the control device in a cooking program only if the operator has previously approved when turning on the cooking program or, in the course of the cooking program, via an operating device of the cooking device. In this way, the operator can select that the cooling device shall be actuated only in such programs in which opening of the door in the course of the program is wanted. In a very simple embodiment, the proximity sensor is switched on when enabled by the operator. In programs in which the proximity sensor is used also for other purposes, non-enabling can be implemented by suppressing a triggering of the control command for actuating the cooling device.

As described under E., it is advantageous also for the other cooling device versions if the control device deactivates the cooling device when a door opening sensor does not detect, within a predetermined period of time after the control command has been triggered by the signal or measured value of the proximity sensor, that the door is open by more than a gap.

A cooking device for carrying out one of the above-described embodiments of a method according to the invention, in particular an oven or a steam cooker, is equipped with a cooking chamber, with a door for closing a front loading opening of the cooking chamber, with a cooling device for replacing some of the steam in the cooking chamber by cold air, with a control device for actuating the cooling device as a function of a control command, and with a proximity sensor for generating a signal or measured value as a result of an individual approaching the cooking device. The control device of the cooking device is suitable and configured to carry out the control command for carrying out one of the above-described embodiments of the method. Further advantageous embodiments of the cooking device are also already described in connection with the embodiments of the method.

FIG. 1 shows a perspective view of a cooking device 10 according to the invention in the form of a built-in oven 11. Said built-in oven 11 has a cooking chamber 30, which is not visible in this figure, with a front-side loading opening 36, which is likewise not visible here (see, for example, FIGS.

2*a, b*). The loading opening 36 is closed by a door 40. A control panel 70, in which display devices 71—here a display 710—and operating devices 72—here a pushbutton 720—are arranged, can be seen above the door 40. Of course, unlike in the figure, the display and operating devices 71 and 72 can also be combined to form a touch display. A slot-shaped blow-out and/or suction opening 83, the function of which will be explained later, extends between the upper edge of the door 40 and the lower edge of the control panel 70. A proximity sensor 73 can be seen in the enlarged representation A, which in the embodiment shown here is arranged below the display 710. Of course, the sensor 73 can also be installed at a different location of the device 10, but an arrangement in the control panel 70 is advantageous. The function of the sensor 73 will also be explained later. Furthermore, parts of a door lock 44 can be seen to some extent in FIG. 1.

Figure 2B:
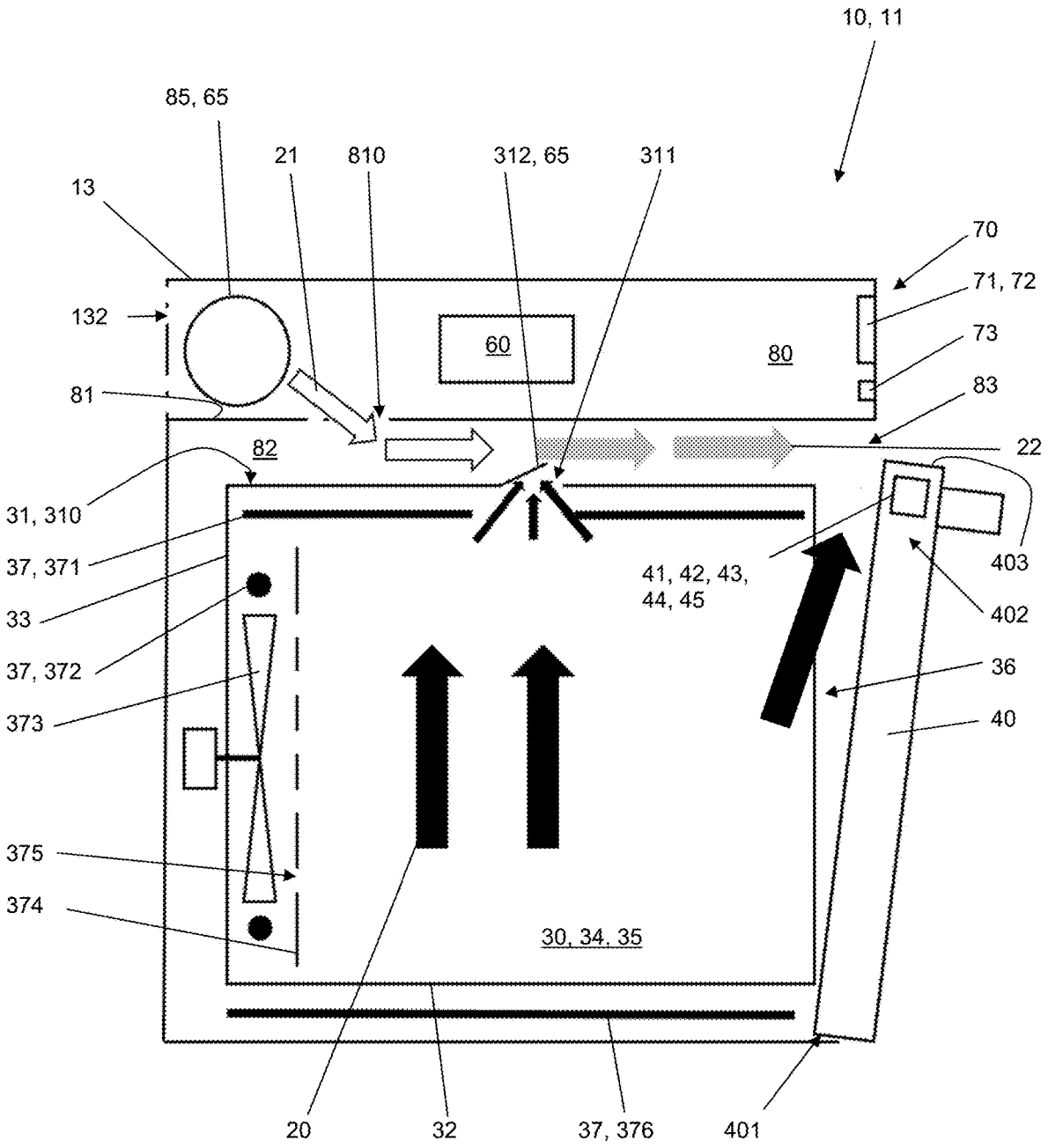
Figure 2C:
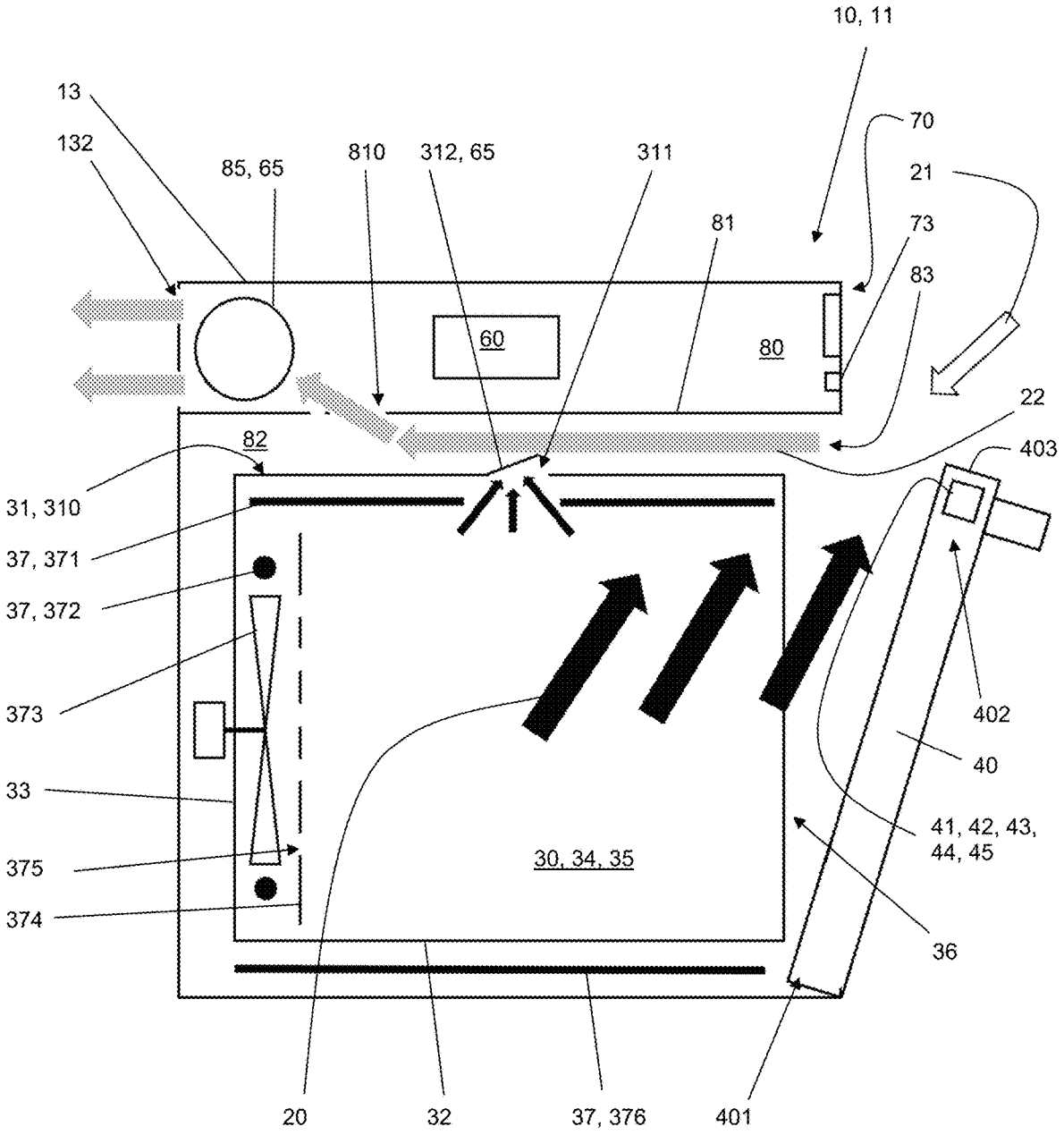

FIGS. 2*a* to *c* show schematic diagrams, on the basis of which functions according to the invention of the built-in oven 11 from FIG. 1 are explained in detail. The oven 11 has a housing 13 which, as already explained in connection with FIG. 1, surrounds a cooking chamber 30 which is open toward the front. The cooking chamber is delimited by walls, namely by a ceiling 31, a base 32, a rear wall 33, and two side walls 34 and 35. An upper heating element 371 and an annular heating element 372 are arranged in the cooking chamber 30 for heating the same; also, a lower heating element 376 is present under the base 32. The heat of the annular heating element 372 can be better distributed in the cooking chamber 30 by an air circulation fan 373 and optionally by a shielding plate 374 with openings 375. Further heating devices 37 such as a microwave heater or a steam generator may be provided in addition to the pure radiation heating elements 371, 372 and 376. However, a cooking device 10 according to the invention can be operated not only as an above-described oven, but also as a microwave oven or steam cooker. In that case, too, radiation heating elements 371, 372, and 376 can be used additionally, but the individual heating devices 37 (upper heat, lower heat, circulating air heating, microwave, steam) will be used differently in the programs of these devices 10 than in the described built-in oven 11. As already described above, the loading opening 36 formed by the open side of the cooking chamber 30) can be closed by a door 40. FIGS. 2*a* to *c* show a device 10 in which the door 40 is designed to be pivotable about a horizontal axis in the region of the lower edge 401. In order to keep the door 40 in the closed state, optionally also to lock the door 40 in a state in which opening is dangerous for an operator and therefore not permissible (for example during a pyrolysis cleaning program), corresponding parts of a door lock 44 are provided in each case in the upper region 402 of the door 40 and in the adjacent region of the housing 13. In the exemplary embodiment according to the invention of the built-in oven 11, the door lock 44 is provided with an integrated automatic opening device 41 which causes an automatic, i.e., not operator-initiated, opening of the door 40 by a gap. The term "gap" is understood to mean an opening by a few angular degrees compared to the completely closed state (hereinafter referred to as closed) so that the shortest measured distance of the upper door edge 403 from the housing 13 is between one and five centimeters. This state of the door 40 is referred to below as "open by a gap." Each opening of the door 40 in excess thereof is referred to as open. Of course, the automatic opening device 41 can also be integrated at a different location of the housing 13 and/or door 40, i.e., not in the door lock 44. In addition to the automatic opening device 41, an automatic closing device 42 is advantageously provided, with which the door open by a gap can be closed again in such a way that the gap is at least approximately zero centimeters. In the simplest form, such a closing device 42 is realized by a spring arrangement, for example in the region of the door hinges. The automatic opening device 41, in particular when not integrated into the door lock, can be designed as a motorically or otherwise electrically operable slider. In the exemplary embodiment shown in FIGS. 2*a* to *c*, the box 43 indicates the variant in which the door lock 44 and the automatic opening and closing device 41 and 42 are integrated into an assembly. A possible structure and a possible function of such a door lock are disclosed, for example, by European patent applications EP 3 324 124 A1 and EP 3 324 125 A1, and are therefore not described in more detail herein. In that case, a door opening sensor 45 is also integrated into such a door lock 44. The door opening sensor 45 detects at least the three states "door closed," "door open by a gap." and "door open" and is able to provide distinguishable signals or measured values to a control device 60 by means of which the latter can recognize the different opening states and respond thereto by corresponding programming.

Figure 3A:
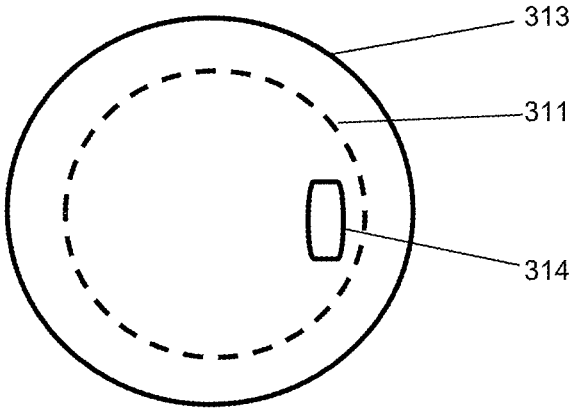
FIG. 3*a* to *c* show schematic diagrams of the first flap unit in different states.
Figure 3B:
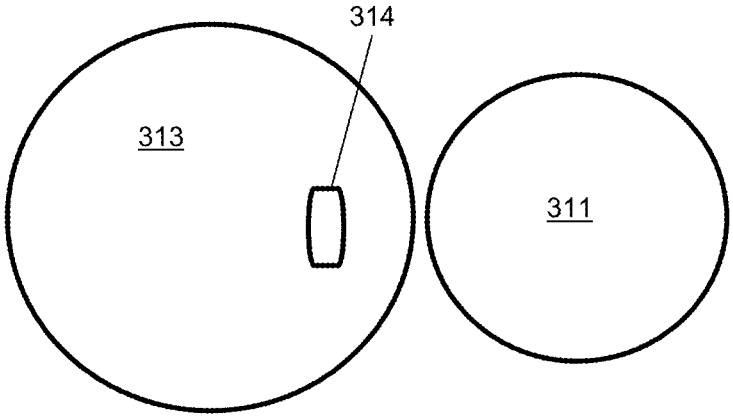
Figure 3C:
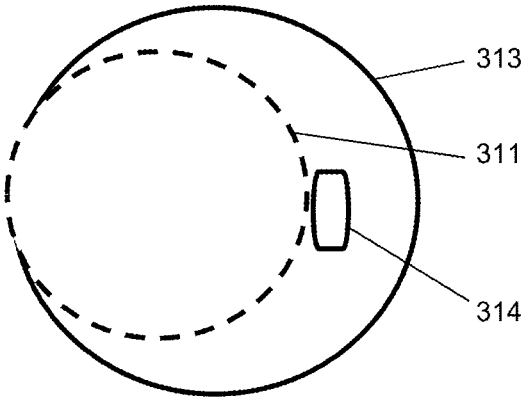

In FIGS. 2*a* to *c*, one can still see that a first opening 311 is arranged in the ceiling 31. An adjustable first flap unit 312, with which the opening cross section can be changed, is arranged above the first opening 311. For reasons of simplicity, the first flap unit 312 is herein shown to be pivotable. The flap unit 312 and its adjusting device (actuating drive in the form of an electric motor) will preferably be designed to have a structure, as known from DE 10 2016 121 834 A1 and schematically shown in FIGS. 3*a* to *c*. This means that a flap 313 with an integrated smaller flap opening 314 will be arranged above the larger first opening 311 and can be displaced in a plane parallel to the plane of the opening 311. In that case, there is a first state in which the flap opening 314 lies above the first opening 311 (small opening. FIG. 3*a*) and accordingly only the opening cross section of the flap opening 314 is opened, a second state in which the flap 313 is pushed to the side to completely expose the first opening 311 in the ceiling 31 (enlarged opening, FIG. 3*b*), and a third state in which the flap opening is located next to the first opening 311 and the flap completely closes the opening 311 (closed opening 311, FIG. 3*c*).

Above the cooking chamber 30, a space 80 for electrical and electronic components is partitioned by a sheet 81, which space 80 is likewise surrounded by the housing 13. Said space 80 is delimited by the control panel 70 toward the front, and by the walls of the housing 13 toward the top, sides and rear. The control device 60, which is preferably designed as a microprocessor control, is arranged in the room in addition to other electrical and electronic components. Said control device 60 receives measured values and input data inter alia from the proximity sensor 73 and operating device 72, but also from the door opening sensor 45. It controls, among other things, the first flap unit 312 and the automatic opening and closing device 41 and 42 via control commands; the individual heating devices 37 are also switched on and off by the control device 60 directly or via an interposed power element. The dashed arrows 61 toward the control device 60 symbolize the data lines via which measured values and signals are guided, measured values and signals, the dashed arrows 62 toward components symbolize lines via which control commands are output by the control device 60. Hereinafter, the measured values and signals themselves are denoted by reference sign 61, and the control commands are denoted by reference sign 62. A cooling fan 85 is also arranged in the space 80 for cooling the electrical and electronic components, which cooling fan 85 can both be switched on and off and controlled or regulated in terms of its speed by the control device 60. In a special embodiment, the cooling fan 85 can rotate in both directions of rotation, and the direction of rotation can be set by the control device 60. By rotating in a first direction of rotation, the cooling fan 85 draws in cold air from the surroundings of the cooking device 10 through upper openings 132 in the housing 13 and transports said air as a blow-out air flow into the space 80 for electrical and electronic components. The cold air is symbolized by white arrows 21. A large amount of the blow-out air flow is then guided through openings 810 in the sheet 81 into a flow line 82 which is formed by an intermediate space between the sheet 81 and the ceiling 31 of the cooking chamber 30. There, the air flow flows over the outer side 310 of the cooking chamber ceiling 31 and there over the first opening 311 or the first flap unit 312. In doing so, the air flow picks up hot steam (symbolized by the black arrows 20), which rises from the cooking chamber through the small or enlarged first opening 311, and mixes therewith. The resulting warm air (symbolized by the gray arrows 22) then escapes from the slot-shaped opening 83, which hence functions as a blow-out opening. There is also an embodiment of a cooking device 10, in which the cooling fan 85 and associated air paths are designed such that the steam 20 is sucked from the first opening 311 into the cooling fan 85 and is mixed there with cold air 21 that is also drawn in from the device environment.

Figure 4:
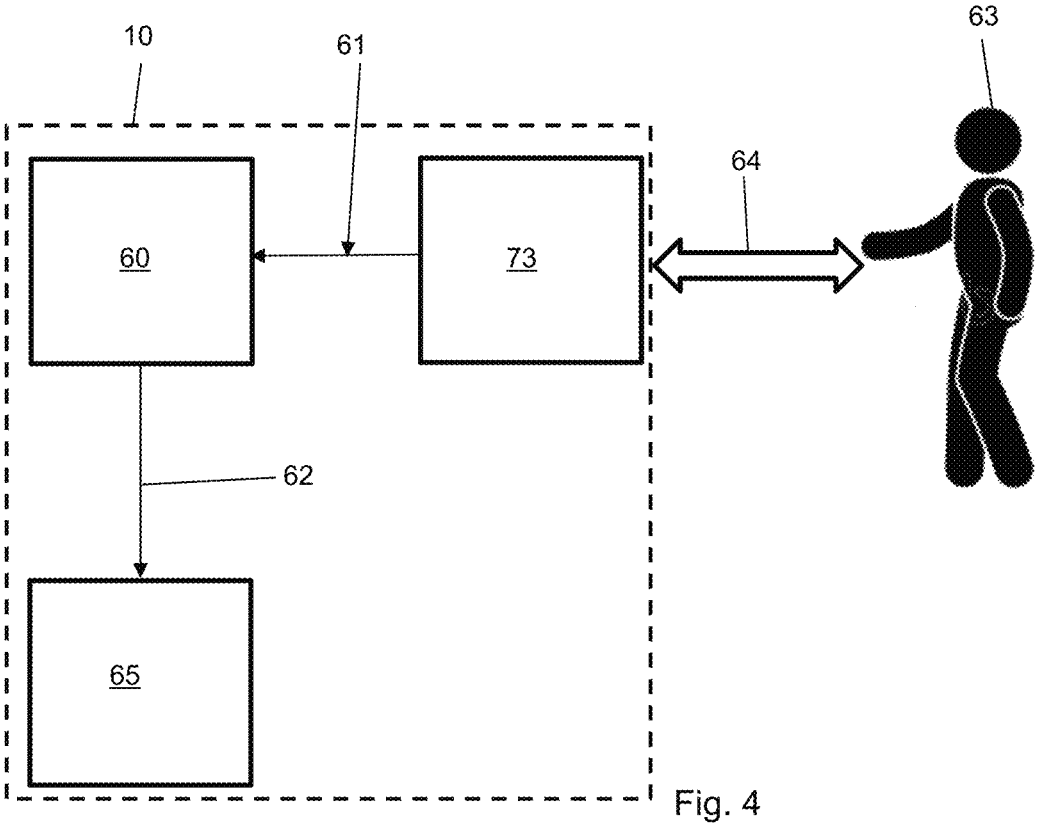
FIG. 4 shows a block diagram of the function of a cooling device according to the invention.

With the cooking device in this embodiment (or the described modifications), individual variants of a method according to the invention for cooling the steam 20 escaping from the cooking chamber 30 by means of a cooling device 65 (see FIG. 4) can be carried out if a corresponding control command 62 is triggered by the control device 60. The method is initially shown in general, i.e., also for the further embodiments, in FIG. 4 by means of a block diagram. For this purpose, the controller 60 has to receive a signal or measured value 61 of the proximity sensor 73 from which it recognizes that an individual 63 has approached the sensor 73 and thus the cooking device 10 up to a predetermined distance 64 (in the region of 1 to 2 meters). The proximity sensor 73 itself can be constructed such that it generates a signal 61 only when the distance falls below said predetermined distance 64. However, it can also continuously supply measured values 61 to the control device 60, the amount of which correlates with the distance 64 of individuals 63 in the region of the device 10, and the control device 60 then triggers the control command 62 for actuating the cooling device 65 when the value of the measured value 61 exceeds a predetermined threshold value. In any case, it is advantageous if the cooling function is not permanently implemented during each operation of the cooking device 10, i.e., in each cooking program (there are programs in which the amount of hot steam in the cooking chamber 30 is so low that it does not constitute a disturbance when the door 40 is opened; there are also situations in which individuals 63 frequently approach the cooking device 10 during a cooking program and where it therefore is not desired that the cooling device 65 be activated each time; also, there are programs such as a pyrolysis cleaning program in which the door 40 cannot be opened at all), but if an operator 63 has to enable the cooling function via the operating device 72 in particular when setting the program. Such enabling can be realized in that the proximity sensor 73 is switched on only in cooking programs in which enabling has taken place. Alternatively, the signals or measured values 61 of the proximity sensor 73 can be evaluated by the control device 60 only in programs in which enabling has taken place. Enabling can also be blocked by the control device 60, for example when a pyrolysis cleaning program is carried out. The following description assumes that whenever the term program or cooking program is used, said program or cooking program has been enabled. However, it is pointed out once again that such an enabling option constitutes only an advantageous embodiment of the invention and does not necessarily have to be present. It is also advantageous if the control device 60 recognizes that an individual 63, to which the proximity sensor 73 has responded, is not even an operator 63 in terms that it will carry out an opening of the door 40. The previously described door opening sensor 45 is provided for this purpose, which detects the three states "door closed," "door open by a gap," and "door open" and is able to output distinguishable signals or measured values 61 to the control device 60 by means of which the control device 60 can recognize the different opening states and respond thereto. After detecting the approach of an individual 63 by way of the signal or measured value 61 of the proximity sensor 73, the control device 60 counts down a predetermined period of time. If, within this period of time, the signal or measured value 61, which correlate with the open state of the door 40, remains absent, the control device 60 deactivates the cooling device 65 and the cooking program is continued.

The following now is a description of the different variants which can be executed with the embodiment according to FIGS. 1 and 2*a* to *c*.

1.1 Increasing the Blow-Out Air Flow of the Cooling Fan 85

For this purpose, when an individual 63 approaches, the control device 60 first switches on and activates the cooling fan 85 if that was not already the case in the running program. If the cooling fan 85 runs or was already running in the program beforehand, its speed is increased by the control device 60 compared to the speed of conventional programs. The easiest way to realize this is if there are several different speed stages (for example a high, a middle, and a low stage) and if the cooling fan 85 is operated in a cooking program at a low or medium speed, or is not operated at all, and if it is switched to high speed for the cooling function. Of course, the cooling fan 85 and the control device 60 can also be designed to realize continuous changes in speed and to then carry out, for example, a percentage increase in speed or an increase in speed by a predetermined speed difference for the cooling function. As already stated in the introduction to the description, the blow-out air flow is increased by the increase in speed, thereby increasing the mixing of the hot steam 20) escaping from the first opening 311 with cold air 21. Hot steam 20 is thus increasingly picked up from the cooking chamber, mixed with cold air 21, and blown out of the opening 83 as warm air 22, which opening 83 in this case functions as a blow-out opening, see FIG. 2*a*. If the operator 63 then opens the door 40, the steam 20 in the cooking chamber 30 has been already partially replaced by cold air 21 and is therefore cooled down so that the temperature and thus the amount of steam 20 escaping from the open loading opening is reduced.

1.2 Increasing the First Opening 311

For this purpose, when an individual 63 approaches, the first flap unit 312 is put into the second state by the control device 60, in which the flap 313 is pushed to the side to completely expose the first opening 311 in the ceiling 31. Hot steam 20 will then increasingly escape from the first opening 311 and from the cooking chamber 30 via the flow line 82 and the blow-out opening 83, see also FIG. 2*a*. As a result, cold air 21 is drawn in via leaks in the cooking chamber 30, and the atmosphere in the cooking chamber 30 is already cooled down when the operator 63 opens the door 40. Advantageously, increasing the first opening 311 is combined with increasing the blow-out air flow of the cooling fan 85 (1.1). As a result, on the one hand, even more steam 20 is sucked out of the cooking chamber and, on the other, the steam 20 which flows out of the blow-out opening 83 is mixed with cold air 21 and cooled beforehand.

1.3 Opening the Door 40 by a Gap

In a further variant, when an individual 63 approaches, the door 40 is put into an open-by-a-gap state. Hot steam 20 then flows out of the open gap (see FIG. 2*b*) and is replaced by fresh cold air 21. The atmosphere in the cooking chamber is thereby cooled down when an operator 63 opens the door 40 completely. This variant can also advantageously be combined with one or both of the measures described under 1.1 and 1.2. As a result, the steam 20 escaping from the door gap is mixed with the cold or warm air 21 or 22, which through the flow line 82 flows out of the blow-out opening 83.

1.4 Reversing the Direction of Rotation of the Cooling Fan 85

A reversal of the direction of rotation of the cooling fan 85 (this relates to the rotor, and thus to the fan blades of the cooling fan 85) in a second direction of rotation by the control device 60, when an individual 63 approaches, will convert the blow-out air flow into a suction air flow. The resulting air flow is shown in FIG. 2*c* for a cooking device 10 with a partially open door 40. Cold air 21 from the surroundings in front of the cooking device 10 is conveyed through the opening 83 now acting as a suction opening and into the flow line 82. In this case, the cold air 21 mixes with the hot steam 20, which escapes from the door 40 opened by the operator 63 and is also drawn in, already in front of the cooking device 10. The warm air resulting from such mixing is conveyed through the flow line 82 and the openings 810 in the sheet 81 to the cooling air fan 85 and is from there discharged to the atmosphere. By drawing in the hot steam 20 and mixing it with the cold air 21, the steam 20 is not only cooled, but is also directed away from the operator 63, so that the door 40 can be opened safely. This variant, too, can be combined with one or more other measures, in particular with increasing the first opening 311, as described under 1.2—in this case, some of the hot steam 20 is also sucked out of the cooking chamber 30 and cooled already there—and/or particularly advantageously with opening the door 40 by a gap, as described under 1.3—in this case, some of the steam 20 is removed from the cooking chamber via the door open by a gap and is replaced by colder air 21 even before the operator 63 arrives at the device 10.

2. Second Embodiment

Figure 5A:
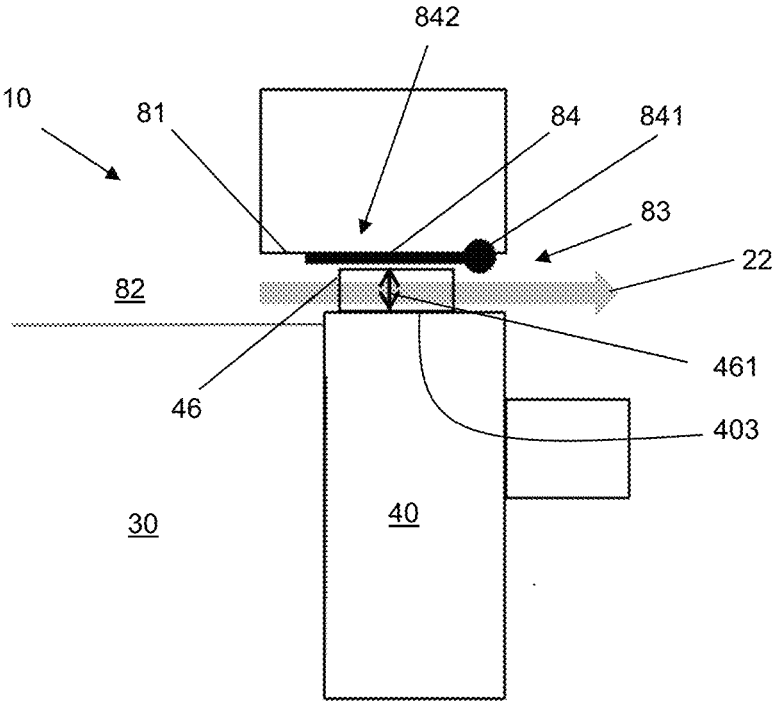
FIG. 5*a, b* show schematic diagrams of a part of a built-in oven 11 in a second embodiment (not according to the invention)

FIGS. 5*a* and *b* show a further embodiment of a cooking device 10 which is modified in the region of the blow-out/suction opening 83. For this purpose, a strip 84 is mounted pivotably on the front end of the flow line 82, preferably on the sheet 81, the underside of which delimits the flow line 82 upwards. The pivot axis 841 of the strip 84 extends parallel to the longitudinal extent of the blow-out/suction opening 83 at least approximately over the entire width of the cooking device 10. If necessary, recesses in the region of the door lock 44 can be provided. The support of the strip 84 is designed such that it falls into the position shown in FIG. 5*b* (deflection position 843) solely due to gravity. At least one pusher 46 is arranged on the upper edge 403 of the door 40, which pusher is dimensioned in terms of its longitudinal extension 461 such that it engages into the pivoting region of the strip 84 so far as to press the strip 84 into an at least approximately horizontal position (inactive position 842) when the door 40 is closed, see FIG. 5*a*. Preferably, the pusher 46 should take up only a few millimeters in its transverse extension (is directed toward the plane of the drawing) so as to block the blow-out/suction opening 83 only to a small extent when the door 40 is closed.

2.1 Mode of Operation

Figure 5B:
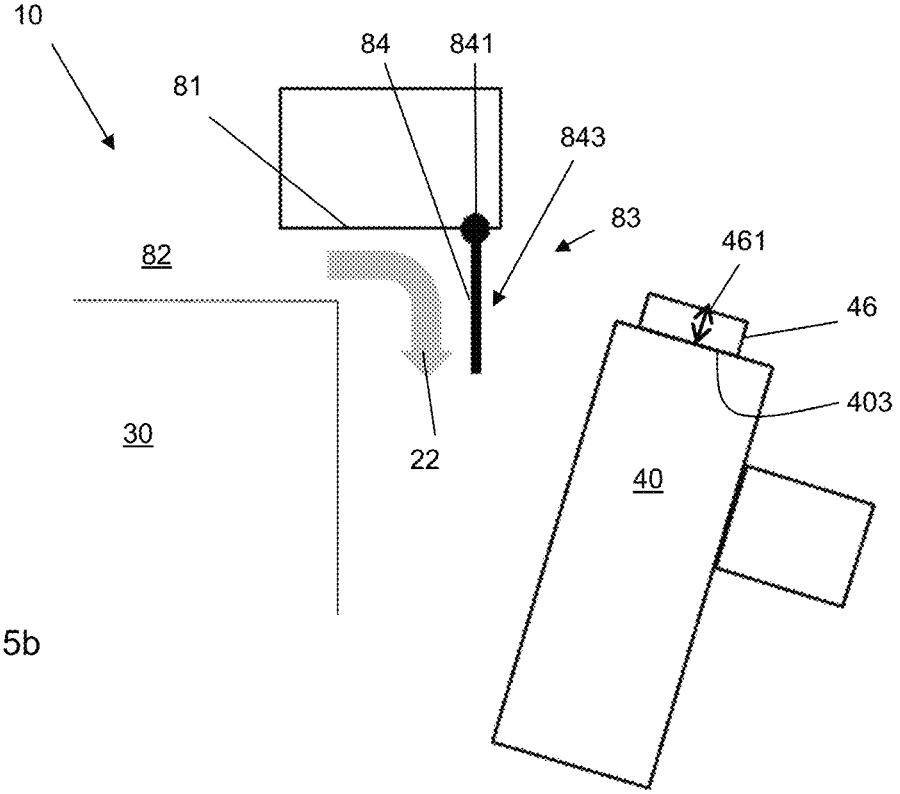

FIGS. 5*a* and 5*b* illustrate the mode of operation of the embodiment by showing the flow conditions. In FIG. 5*a*, when the door 40 is closed, the strip 84 is pivoted backwards by the pusher 46 into its horizontal, inactive position 842. In this position, the blow-out air flow generated by the cooling fan 85 (see FIGS. 2*a* to *c*) can escape from the blow-out opening 83 substantially unhindered past the one or more pushers 46 and through the flow line 82. When the door 40 is opened as shown in FIG. 5*b*, the strip falls into its vertical deflection position 843 and deflects the blow-out air flow downwards after escaping the blow-out opening 83. An air curtain is thereby formed which reduces an outflow of hot steam 20 (see FIGS. 2*a* to *c*) from the cooking chamber 30. This function per se is known from the prior art and is therefore not according to the invention. Also, it does not represent a cooling device according to the invention, since the steam 20 is here only prevented from escaping from the cooking chamber 30, but is not cooled. However, it can be used very advantageously with the measure described under 1.1 of increasing the blow-out air flow of the cooling fan 85, and even more advantageously with the additional measure described under 1.2 of increasing the first opening 311 (see FIGS. 2*a* to *c*). A combination of this measure and the measure described under 1.3 of opening the door 40 by a gap when the operator 63 approaches is particularly advantageous. The strip 84 is then in the deflection position 843 already before the door 40 is completely opened, and the protective air curtain is already in place. Of course, a combination with the measures described under 1.1 and/or 1.2 is also possible.

3. Third Embodiment

FIGS. 6*a* to *c* show a further embodiment according to the invention of a cooking device 10 with a cooling device 65. Here, a second opening 330, which is preferably arranged in the rear wall 33 of the device 10 as can be seen in FIG. 6*a*, acts as a cooling device 65 in combination with a second flap unit 331, which is shown in two different views in FIGS. 6*b* and 6*c*. The flap unit 331 comprises a closing plate 332 which can be moved into two different positions via a pivot arm 333 by means of an actuating drive in the form of an electromagnet 334, namely into a closed position (shown in FIGS. 6*b* and 6*c*) and an open position (schematically indicated in FIG. 6*a*). The electromagnet 334 is operated by the control device 60 and, as already described above in connection with the other cooling devices 65, actuated whenever the control device 60 detects the approach of an individual 63 by means of the proximity sensor 73. By using an electromagnet 334, a very rapid actuation of the pivot arm 333 and the closing plate 332 within a period of less than one second is possible.

3.1 Mode of Operation

When an individual 63 approaches, the proximity sensor 73 outputs a signal 61 to the control device 60. The control device 60 then outputs a control command 62 to the electromagnet 334 which moves the closing plate 332 via the pivot arm 333 into the open position shown in FIG. 6*a*. Cold air 21 then flows through the second opening 330 into the cooking chamber 30 and mixes with the hot steam 20 and cools it down. Preferably, the control device 60 also switches on the air circulation fan 373, if that was not already the case in the running program, in order to enhance the mixing of the cold air 21 and the hot steam 20. Particularly preferably, the flap 313 of the first flap unit 312 is also pushed to the side (see 1.2), and the first opening 311 in the ceiling 31 is completely opened, so that the mixture of cold air 21 and hot steam 20 (warm air 22) can even better flow out of the cooking chamber 30 via the flow line 82 and the blow-out opening 83 and more cold air 21 is drawn in through the second opening 330. In particular, the blow-out air flow of the cooling fan 85 can then also be increased (see 1.1) and the above-described effect can be further enhanced. Opening of the door 40 by a gap (see 1.3) can also be advantageous.

Of course, with this embodiment it is also advantageous if, as described under 1., the cooling device 65 is deactivated again when the control device 60 detects that the individual 63 approaching is not an operator 63.

4. Fourth Embodiments

Figure 7A:
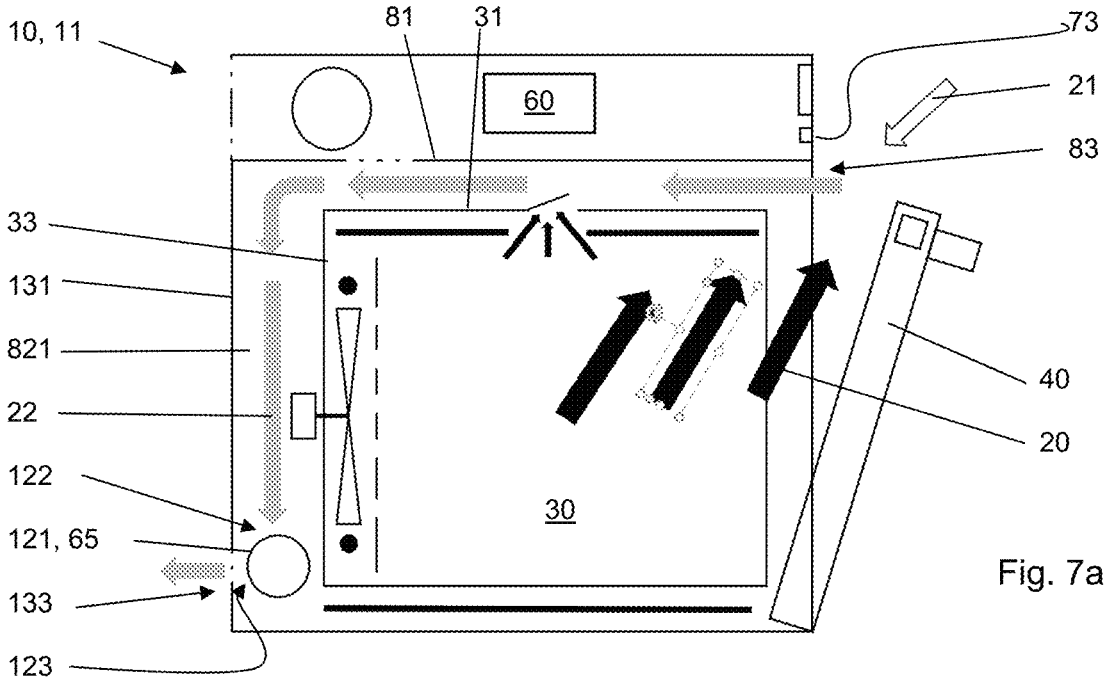
FIG. 7*a, b* show schematic diagrams of fourth embodiments of a built-in oven 11 according to the invention.
Figure 7B:
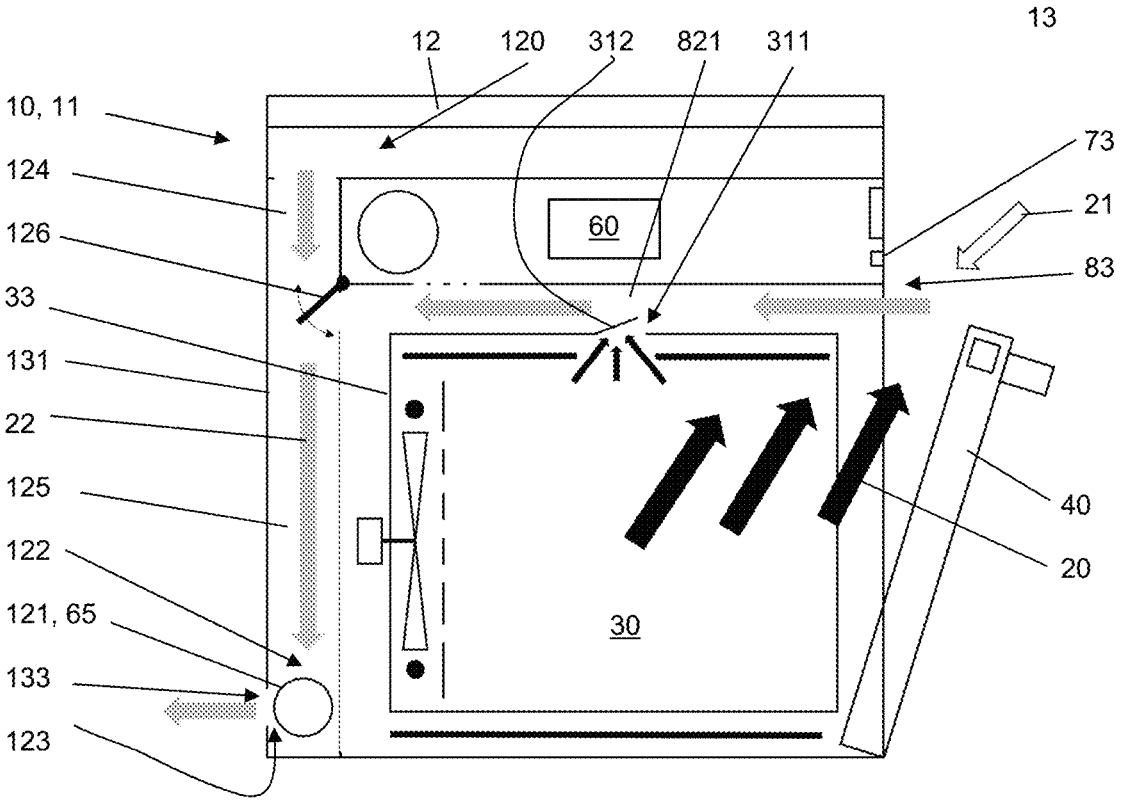

FIGS. 7*a* and 7*b* show two different embodiments of cooking devices 10, in which a further fan 121 is present as a cooling device 65, which further fan 121 extracts the hot steam 20 from the cooking chamber 30 and replaces it by cold air 21. FIG. 7*a* shows as a first embodiment the cooking device 10 using the example of a built-in oven 11. The fan 121 is integrated in the rear, lower part of the device 11 in the space between the cooking chamber rear wall 33 and the housing rear wall 131. The suction region 122 is directed into a flow line 821 which, in this device, extends not only from the blow-out/suction opening 83 into the intermediate space between the sheet 81 and the ceiling 31 of the cooking chamber 30, but also at the rear side of the device into the intermediate space between the cooking chamber rear wall 33 and the housing rear wall 131. The blow-out region 123 of the fan 121 is directed toward a lower opening 133 in the housing rear wall 131. In an alternative not shown in the drawings, the further fan 121 can also be arranged outside the built-in oven 11, for example in a base of a kitchen unit. The flow line 821 must then be extended by means of a suction tube or a suction pipe between the lower opening 133 in the housing rear wall 131 and the suction region 122 of the fan 121. The fan 121 is switched on/off and optionally also speed-controlled by the control device 60.

In the embodiment according to FIG. 7*b*, a cooktop 12 is also provided in addition to a built-in oven 11 or other cooking device 10 with cooking chamber 30, such as a steam cooker or microwave, which cooktop 12 is equipped with a device 120 for extracting cooking fumes. The further fan 121 is then also a component of this device 120 and can extract, via a further flow line 124 guided by an opening in the region of the hob 12 up to the suction region 122 of the fan 121, cooking fumes produced in the region of the hob 12 when cooking water and cooking food. The flow line 821, which is described in the preceding exemplary embodiment (FIG. 7*a*), from the blow-out/suction opening 83 to the suction region 122 of the further fan 121 is also present. As shown in FIG. 7*b*, the system 13 consisting of the cooktop 12 and the cooking device 10 with cooking chamber 30 can be designed as a combined unit, for example as a stove or as a built-in oven, built-in steam cooker or built-in microwave, with a cooktop arranged directly above it. It can then be advantageous if the two flow lines 124 and 821 have a common part 125 arranged, in particular, in the cooking device 10 with cooking chamber 30. Preferably, a switching device 126 actuated by the control device 60 can be arranged at the interface of the two separate parts of the flow lines 124 and 821, via which switching device 126 the one or the other separate part of the flow lines 124 or 821 can optionally be blocked. In this way, it is ensured that the further fan 121 is active only for the region enabled in each case. As an alternative to the embodiment shown in FIG. 7*b*, the cooktop 12 can also be arranged separately from the cooking device 10 with cooking chamber 30, i.e., not directly above it. The flow lines 124, 821 and 125 are then at least partially connected to the further fan 121 via tube/pipe connections. The fan 121 itself can then be installed, for example, in a kitchen base. In that case, the switching device 126 will then either be associated with the further fan 121 (either integrated or installed in front of same), or part of the switching device 126 is arranged both in the cooktop 12 and in the cooking device 10 and can open or close the corresponding flow line 124 or 821.

Either a control device 60 can be provided which works both for the cooking device 10 and the cooktop 12. Alternatively, both device parts 10 and 12 can have separate control devices 60, but it must then be ensured that these control devices 60 can perform a data exchange for realizing the cooling function of a cooling device 65 according to the invention, or that the control device 60 of the cooking device 10 can control the components which are necessary for realizing such a cooling function. In an arrangement in which the further fan 121 is installed separately from at least one of the devices cooktop 12 and cooking device 10, there will be data lines or a wireless data transmission between the control device(s) 60 and the fan 121.

4.1 Mode of Operation

When an individual 63 approaches, the proximity sensor 73 outputs a signal 61 to the control device 60 which is responsible for realizing the cooling function of the cooling device 65 according to the invention. The control device 60 then outputs a control command 62 to the further fan 121 and switches it on (possibly with a preset speed), unless the latter was already switched on during a use of the hob 12 for extracting cooking fumes; in that case, only the speed needs to be adjusted. A further control command 62 is output to the switching device 126. The latter is controlled such that it opens the flow line 821 (and possibly 125) between the blow-out/suction opening 83 and the suction region 122 of the further fan 121 and blocks the further flow line 124 between the opening in the region of the hob 12 and the suction region 122 of the further fan 121. As a result, the hot steam 20 which escapes when the operator 63 opens the door 40 is sucked away from the latter into the opening 83 acting as a suction opening. If, as shown in FIGS. 7*a* and *b*, the first opening 311 is present in the cooking chamber ceiling 31, some of the hot steam 20 is already extracted from the cooking chamber 30 through the opening 311 and replaced by cold air 21. If the opening 311 can be closed by a controllable first flap unit 312, it is advantageous to have the control device 60 put the first flap unit 312 into the second state, in which the flap is pushed to the side to completely expose the first opening 311 in the ceiling 31, see 1.2. A combination with opening the door 40 by a gap, as described under 1.3 is particularly advantageous, because some of the steam 20 is extracted from the cooking chamber 30 via the door 40 open by a gap and replaced by colder air 21 even before the operator 63 arrives at the device 10.

Of course, with this embodiment it is also advantageous if, as described under 1., the cooling device 65 is deactivated again when the control device 60 detects that the individual 63 approaching is not an operator 63. In that case, the switching device 126 should also be controlled such as to block the flow line 821 between the blow-out/suction opening 83 and the suction region 122 of the further fan 121, and to open the further flow line 124 between the opening in the region of the hob 12 and the suction region 122 of the further fan 121. Such switching should also be carried out when the cooling process is completed, which is determined by the control device 60 for example after a predetermined time has elapsed following the complete opening of the door 40 (detected by the door opening sensor 45)

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCES

10 Cooking device
11 Built-in oven
12 Hob
13 System of cooktop and cooking device
14 External environment
120 Apparatus for extracting cooking fumes
121 Further fan
122 Suction region
123 Blow-out region
124 Further flow line
125 Common part of the flow lines 124 and 821
126 Switching device
13 Housing
131 Housing rear wall
132 Upper openings
133 Lower opening
20 Vapor or steam
21 Cold air
22 Warm air
30 Cooking chamber
31 Ceiling
310 Outer side
311 First opening
312 First flap unit
313 Flap
314 Flap opening
32 Base
33 Rear wall
330 Second opening
331 Second flap unit
332 Closing plate
333 Pivot arm
334 Electromagnet
34 Side wall
35 Side wall
36 Loading opening
37 Heating device
371 Upper heating element
372 Annular heating element
373 Air circulation fan
374 Shielding plate
375 Openings
376 Lower heating element
40 Door
401 Lower edge
402 Upper region
403 Upper door edge
41 Automatic opening device
42 Automatic closing device
43 Box
44 Door lock
45 Door opening sensor
46 Pusher
461 Longitudinal extension
60 Control device
61 Arrow for signal or measured value
62 Arrows for control command
63 Individual, operator
64 Distance
65 Cooling device
70 Control panel
71 Display device
710 Display
72 Operating device
720 Pushbutton
73 Proximity sensor
80 Space for electrical/electronic components
81 Sheet
810 Openings
82 Flow line
821 Flow line (FIGS. 6*a, b*)
83 Blow-out/suction opening
84 Strip
841 Pivot axis
842 Inactive position
843 Deflection position
85 Cooling fan

The invention claimed is:

1. A method for cooling vapor or steam escaping from a cooking chamber of a cooking device equipped with a cooking chamber, a door for closing a front-side loading opening of the cooking chamber, a cooling device for replacing some of the vapor or steam in the cooking chamber with cold air, and a control device for actuating the cooling device as a function of a control command, the method comprising:

triggering the control command by a signal or measured value of a proximity sensor arranged on the cooking device, the signal or measured value being generated by the proximity sensor as a result of an individual approaching the cooking device, wherein the cooling device is actuated as a function of the control command of the control device in a cooking program only if an operator has previously approved when turning on the cooking program or, during the cooking program, via an operating device of the cooking device.

2. The method of claim 1, wherein the cooling device executes at least one of the following method steps as a result of the control command of the control device:

increasing a blow-out air flow of a cooling fan of the cooking device, the blow-out air flow picking up some of the vapor or steam from the cooking chamber via a first opening in a ceiling of the cooking chamber and transporting it away from the cooking device via a flow line;

generating a suction air flow by the cooling fan or by a further fan of the cooking device, the suction air flow being drawn in by the cooling fan or the further fan via a flow line extending at least from the cooling fan or the further fan up to a blow-out/suction opening above the cooking chamber;

increasing the first opening in the ceiling by moving an adjustable first flap unit of the cooking device;

opening a second opening in one cooking chamber wall by moving an adjustable second flap unit of the cooking device;

opening the door by an automatic opening device of the cooking device.

3. The method of claim 2, wherein the air flow of the cooling fan is increased by an increase in fan speed by the control device.

4. The method of claim 2, wherein the suction air flow is generated by a reversal of a direction of rotation of the cooling fan by the control device.

5. The method of claim 2, wherein the first flap unit or second flap unit is moved by actuating drives actuated by the control device.

6. The method of claim 2, wherein the control unit and the second flap device are configured to open the second opening within a period of less than 5 seconds.

7. The method of claim 2, wherein, upon opening of the second opening via the control device, the control devices switches on an air circulation fan for circulating the air or vapor or steam in the cooking chamber.

8. The method of claim 1, wherein the proximity sensor is switched on when enabled by the operator.

9. The method of claim 1, wherein the control device deactivates the cooling device when a door opening sensor does not detect, within a predetermined period of time after the control command has been triggered by the signal or measured value of the proximity sensor, that the door is open by more than a gap.

10. The method of claim 9, wherein the control device completely closes the door by an automatic closing device if the door opening sensor does not detect, within a predetermined period of time after the control command has been triggered by the signal or measured value of the proximity sensor, that the door is open by more than a gap.

11. A cooking device, comprising:

a cooking chamber with a door for closing a front loading opening of the cooking chamber;

a cooling device configured to replace some vapor or steam in the cooking chamber with cold air;

a control device configured to actuate the cooling device as a function of a control command; and a proximity sensor configured to generate a signal or measured value as a result of an individual approaching the cooking device, wherein the control device is configured to carry out the control command for performing a method for cooling vapor or steam escaping from the cooking chamber, the method comprising: triggering the control command by the signal or measured value of the proximity sensor, wherein the cooling device is actuated as a function of the control command of the control device in a cooking program only if an operator has previously approved when turning on the cooking program or, during the cooking program, via an operating device of the cooking device.

12. The cooking device of claim 11, further comprising:

a flow line configured to guide a blow-out air flow or suction air flow, which extends at least from a cooling fan or a further fan up to a blow-out/suction opening above the cooking chamber.

13. The cooking device of claim 12, further comprising:

a cooktop arranged in an upper region of the cooking device; and an extraction device configured to extract cooking fumes produced in a region of the cooktop, wherein the extraction device comprises the further fan.

14. The cooking device of claim 13, further comprising:

a further flow line between the cooktop and the further fan; and a switching device actuatable by the control device and configured to establish a fluid connection between the further fan and the blow-out/suction opening.

15. The cooking device of claim 12, further comprising:

a first opening in a ceiling of the cooking chamber which fluidly connects the cooking chamber to the flow line and is at least partially closable by a first flap unit.

16. The cooking device of claim 15, further comprising:

a second opening in a rear wall of the cooking chamber which fluidly connects the cooking chamber to an external environment of the cooking device and which is at least partially closable by a second flap unit.

17. The cooking device of claim 12, further comprising:

a pivotable strip arranged in a region of the blow-out/suction opening, which, in a first position, is configured to release blow-out air flow at least approximately in a direction of the flow line from the blow-out/suction opening and, in a second position, is configured to deflect the blow-out air flow in a direction parallel to the loading opening.

18. The cooking device of claim 17, wherein the pivotable strip projects with at least one part into a pivoting region of at least one part of the door such that the pivotable strip is in the first position when the door is closed and is in the second position when the door is open.

19. The method of claim 1, wherein the cooking device comprises an oven or steam cooker.

20. A method for cooling vapor or steam escaping from a cooking chamber of a cooking device equipped with a cooking chamber, a door for closing a front-side loading opening of the cooking chamber, a cooling device for replacing some of the vapor or steam in the cooking chamber with cold air, and a control device for actuating the cooling device as a function of a control command, the method comprising:

triggering the control command by a signal or measured value of a proximity sensor arranged on the cooking device, the signal or measured value being generated by the proximity sensor as a result of an individual approaching the cooking device, wherein the control device deactivates the cooling device when a door opening sensor does not detect, within a predetermined period of time after the control command has been triggered by the signal or measured value of the proximity sensor, that the door is open by more than a gap.

* * * * *